US006471080B1

(12) United States Patent
Hoffmann

(10) Patent No.: US 6,471,080 B1
(45) Date of Patent: Oct. 29, 2002

(54) FLOATING PARTITION FOR FILING EQUIPMENT

(75) Inventor: Thomas A. Hoffmann, Saukville, WI (US)

(73) Assignee: Tab Products Company, Inc., Vernon Hills, IL (US)

( * ) Notice: Subject to any disclaimer, the term of this patent is extended or adjusted under 35 U.S.C. 154(b) by 0 days.

(21) Appl. No.: 09/908,874

(22) Filed: Jul. 20, 2001

(51) Int. Cl.[7] ..... A47F 5/00

(52) U.S. Cl. ..... 211/126.1; 211/126.5; 211/184; 211/88.01

(58) Field of Search ..... 211/126.1, 126.2, 211/126.5, 126.15, 184, 94.01, 88.01, 133.1, 133.3

(56) References Cited

U.S. PATENT DOCUMENTS

| | | | | |
|---|---|---|---|---|
| 2,688,409 A | * | 9/1954 | Echlin | 211/184 |
| 3,031,088 A | * | 4/1962 | Ribbens et al. | |
| 3,047,158 A | * | 7/1962 | Scholl | |
| 3,358,956 A | | 9/1965 | Thornton | |
| 3,241,898 A | * | 3/1966 | Propst | |
| 3,486,634 A | * | 12/1969 | Frater | |
| 3,527,353 A | | 9/1970 | Farren | |
| 3,698,565 A | * | 10/1972 | Weber | |
| 4,228,906 A | * | 10/1980 | Jones | |
| 4,552,272 A | | 9/1985 | Field | |
| 4,944,417 A | * | 7/1990 | Datlow | 211/184 |
| 5,287,974 A | * | 2/1994 | Buday | 211/184 |
| 5,881,892 A | * | 3/1999 | Loo | 211/133.3 |
| 5,971,173 A | | 10/1999 | Valiulis | |

FOREIGN PATENT DOCUMENTS

| | | |
|---|---|---|
| DE | 2245271 | 4/1973 |
| FR | 2451-785 | 10/1980 |

* cited by examiner

*Primary Examiner*—Robert W. Gibson, Jr.
(74) *Attorney, Agent, or Firm*—Donald Cayen

(57) ABSTRACT

A floating partition provides a visual divide along a long section of boxes in a rack and box filing system. The floating partition has a thin panel with top and bottom fingers. The fingers rest on respective rails of the system rack. A bottom edge of the partition panel is spaced from a base cover. A tab on at least the top finger enables the floating partition to be installed anywhere along the rails. A three-dimensional contour along a front edge of the floating partition enhances the visual divide along the boxes and also increases panel rigidity.

29 Claims, 4 Drawing Sheets

55

X
51
52
47
56
43
37
41
49
53
54
57
61
59
45
63
67
65
31
35
33
29
39

FLOATING PARTITION FOR FILING EQUIPMENT

BACKGROUND OF THE INVENTION

1. Field of the Invention.

This invention pertains to document storage, and more particularly to apparatus that divides large sections of stored media into smaller sections.

2. Description of the Prior Art.

Various equipment has been developed to aid in filing and retrieving documents. At a basic level, file folders of various sizes are well known and in widespread use for holding individual documents. To store a quantity of file folders, a variety of cabinets and shelvings are commercially available.

A common type of filing equipment is made as a cabinet with pairs of longitudinally spaced end posts. Rows of horizontal shelves are supported by the end posts. Depending on the filing capacity needed, pairs of intermediate posts can be used between the end posts to support the shelves. The file folders are vertically oriented and stacked in flat facing contact next to each other along the lengths of the shelves. In many applications, the cabinet is incorporated into a frame that is moveable along a building floor in a manner that conserves floor space in the building.

Another well known system for storing file folders uses a rack and suspended boxes as disclosed, for example, in U.S. Pat. No. 3,031,088. The rack is constructed with horizontal rails supported by and extending between upright posts. The boxes have open tops and fronts and hooks on their back walls. A number of boxes are suspended in rows on the rails by means of the hooks. Lower ends of the back walls of the boxes in one row rest against the rail that supports the next lower row of boxes. A relatively small number of file folders are stacked in vertical orientation in each box. If desired, the boxes and their contents can be removed together from the rack and carried to a different location.

In many applications of rack and box filing systems, the systems are double-faced. That is, rails are on both sides of the vertical plane containing the posts. Two banks of boxes are then suspendable back-to-back on respective rails. In that situation, the weight of the boxes and the media filed in them is generally approximately equal in both banks. The load carried by the posts is almost exclusively compressive.

On the other hand, many applications of rack and box filing systems are single-faced, having a bank of boxes on only one side of the plane containing the posts. In those situations, a bending load is applied to the posts. Consequently, the posts deflect along their lengths. A common loading for commercially available rack and box filing systems is approximately two pounds per linear inch along the rack. Under such loading, the tops of the posts deflect as much as approximately 0.38 inches in the horizontal direction.

Both the shelf filing systems and the rack and box filing systems can reach long lengths. Lengths of 40 feet are not uncommon. In both cabinet shelf filing systems and rack and box filing systems, the file folders are usually coded in some fashion. The codes enable filing personnel to quickly locate the desired folder. For example, the file folders may be arranged in alphabetical order, with file folders continuing or. lower shelves or rows of boxes as upper shelves or boxes become filled.

It is commonly known that long uninterrupted rows of file folders can be difficult to use. Filing personnel can more efficiently retrieve and refile the file folders if there is a visual break between the ends of the rows. If a physical visual break is lacking, the filing personnel often create imaginary boundaries between subsets of files. However, over time the files can shift outside the imaginary boundaries.

In cabinet shelf filing systems, individual partitions could be installed on the shelves. The partitions normally fit into slots in the horizontal shelves and in a back wall. The partitions worked well for breaking long rows of file folders into shorter sections. However, the prior partitions used with cabinet shelf filing systems had the disadvantage of being restricted to the locations of the slots in the shelves and back wall. Such locations were often not optimum for the particular filing requirements at hand. In addition, in order to divide more than one shelf, a different partition had to be installed in each shelf; there was no way for a partition to divide more than one shelf.

Regarding rack and box filing systems, prior to the present invention no means existed for visually breaking long rows of boxes.

SUMMARY OF THE INVENTION

In accordance with the present invention, a floating partition is provided for rack and box filing systems that divides the full height of a large section of stored files into smaller sections. This is accomplished by a panel that does not deform when used on a single-face rack and box filing system.

According to one aspect of the invention, the floating partition is incorporated into a single-face rack that includes a decorative horizontal base cover. The floating partition is comprised of a relatively thin panel having a height substantially equal to the height of the rack above the base cover. There is a clearance between the panel bottom edge and the base cover. To enhance the dividing feature of the floating partition, the front edge of the panel is formed with a visually attractive three-dimensional contour. A rounded or rolled contour along the full height of the panel front edge is satisfactory.

The back edge of the panel is provided with means for mounting the floating partition to one or more of the rack rails. In one embodiment of the invention, the means for mounting the floating partition comprises top and bottom fingers that engage the lips of two rails. The fingers may be integral with the panel, or they may be separate pieces.

In the preferred embodiment, the top finger is near the top edge of the panel. The top finger is constructed with an L-shape, and it is coplanar with the panel. The top finger has a first edge that is perpendicular to the back edge of the panel, and a second edge that is parallel to the panel back edge. The second edge is spaced from the panel back edge and cooperates with it and the finger first edge to define a top recess. There is a tab on the top finger, which may be perpendicular to the common plane of the panel and the top finger. Alternately, the tab may be bent over at 180 degrees to the plane of the panel and top finger. Preferably, the tab is along the second edge.

The bottom finger is generally similar to the top finger, having first and second edges. The bottom finger first edge is perpendicular to the panel back edge. The distance between the first edges of the top and bottom fingers is substantially equal to the distance between the lips of two rails on the rack. The second edge of the bottom finger is parallel to the panel back edge and cooperates with the panel back edge and the first edge to define a bottom recess. The bottom finger may include a tab that is similar to the tab on the top finger.

The floating partition is mounted at any desired location along the rack rails between the boxes. The top finger first edge rests on the lip of a first rail on the rack, and the bottom finger first edge rests on a lower rail. The three-dimensional contour of the panel front edge enhances the visual dividing feature of the floating partition. As many floating partitions as desired can be used to suit the requirements at hand.

In a single-face application, the horizontal movement of the rails caused by post deflection is accommodated by the clearance between the panel bottom edge and the base cover. The tab on the top finger straddles any gaps between the ends of abutting rails. Consequently, the floating partition can be located anywhere along the rails without danger that it might slip out of or get stuck in a gap. Because the floating partition is made of thin material, and also because it is infinitely adjustable along the rails, it does not interfere with the boxes suspended from the rails.

The method and apparatus of the invention, using a floating partition having fingers with recesses adjacent a panel back edge, thus divides multiple long sections of filed media of a rack and box filing system into shorter sections. The probability that the floating partition will buckle or deform during use is remote, even though the posts of a single-face system deflect under the weight of the filed media.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
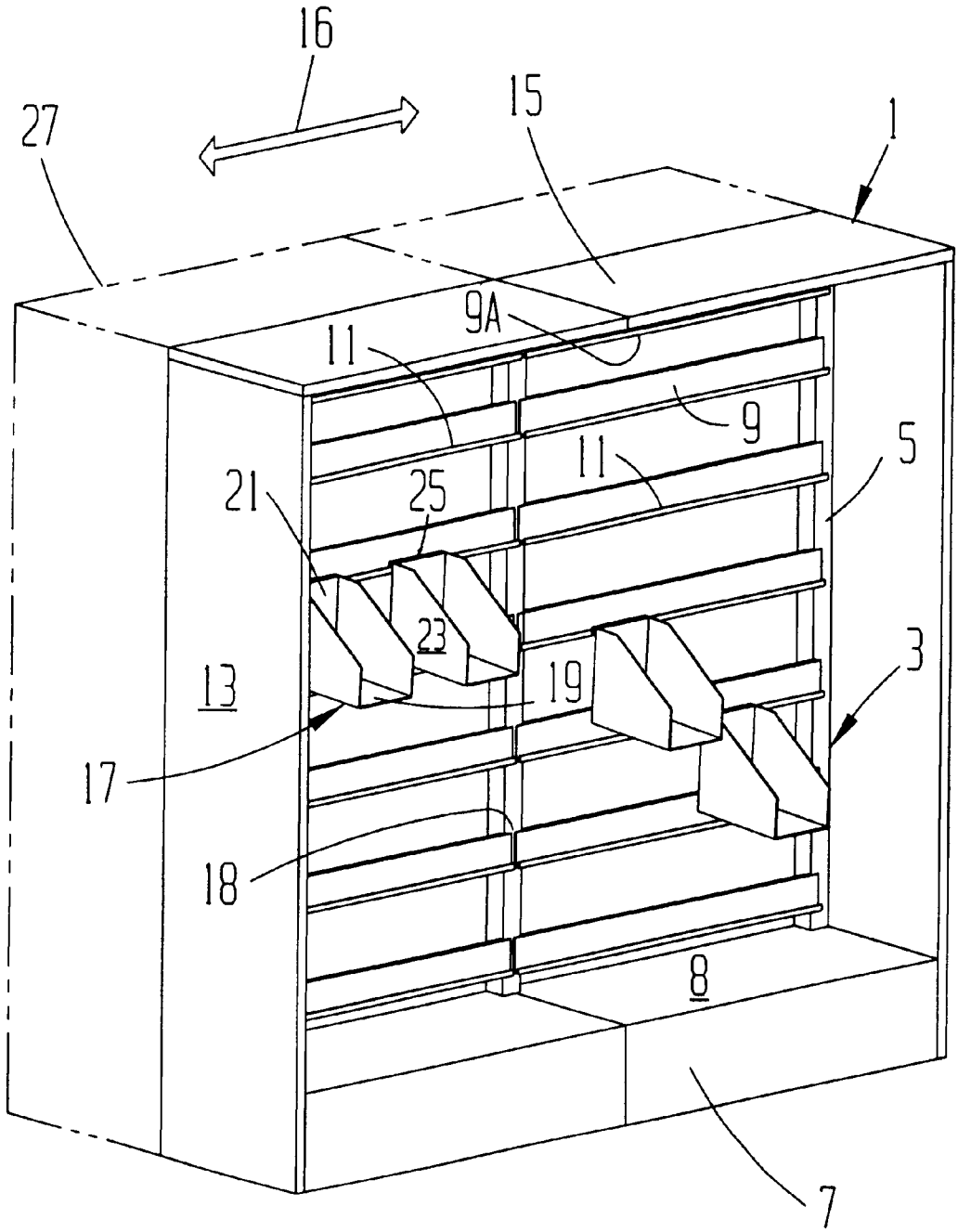
FIG. 1 is a perspective view of a typical rack and box filing system.

Referring to FIG. 1, a rack and box filing system 1 is illustrated that advantageously uses the present invention. The rack and box filing system 1 is particularly useful for storing paper documents inserted into file folders. However, it will be understood that the invention is not limited to applications involving paper related media.

The particular rack and box filing system 1 is comprised of a rack 3 having posts 5 upstanding from a base 7. A decorative base cover 8 with a horizontal top surface covers the base 7. A number of horizontal rails 9 extend between and are attached to the posts 5. As illustrated, the rack 3 has three posts 5 with rails 9 attached to and extending between each pair of posts. However, additional posts and rails can be incorporated into the system 1 such that the rack has a long length in the longitudinal directions 16. There may be gaps 18 between adjacent rails. Each rail 9 has a lip 11. The rails and lips are made from thin material, such as sheet steel approximately 0.06 inches thick. The rack further has side panels and an optional top panel 15.

Suspended from the rails 9 on the rack 3 are a number of boxes 17. Each box 17 has a bottom wall 19, back wall 21, and side walls 23. The tops and fronts of the boxes are open. At the top of each back wall 21 is a hook 25. The hooks 25 hang on the lips 11 of the rails. The lower end of the back wall of a box suspended from a particular rail rests against the next lower rail. The boxes are positioned along the rails at any desired location.

Figure 2:
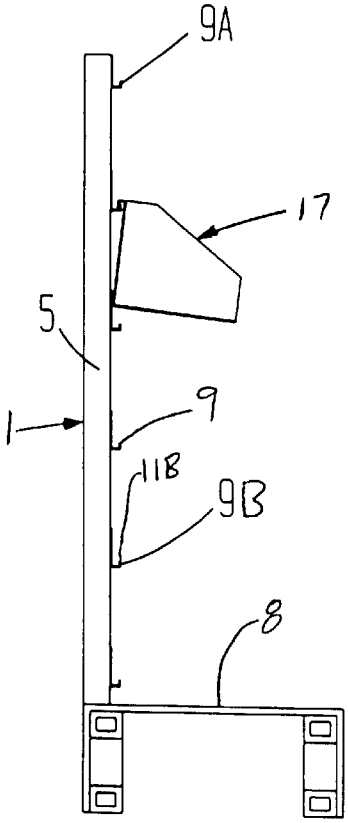
FIG. 2 is a simplified end view of a single-face rack and box filing system without any media stored in the boxes.

The rails 9 and boxes 17 can be suspended from one side of the posts 5 in a single-face installation. Alternately, the rails and boxes can be on both sides of the posts in a double-face installation, as is schematically represented by phantom lines 27. Looking at FIG. 2, the rails and boxes are of a single-face installation. In that situation, the posts 5 are straight and vertical when the rack and box filing system 1 is initially installed. When media is stored in the boxes 17, the posts tend to bend and deflect in the manner of a cantilever beam. At full capacity of the rack and box filing system, the posts deflect a substantial amount, as is shown in exaggerated form in FIG. 2A. Specifically, there is a horizontal deflection D at the tops of the posts. For a rack with posts six feet high, and with seven rails, and boxes loaded to give a load of approximately two pounds per linear inch along the rails, the deflection D is as much as approximately 0.38 inches.

Figures 3, 4:
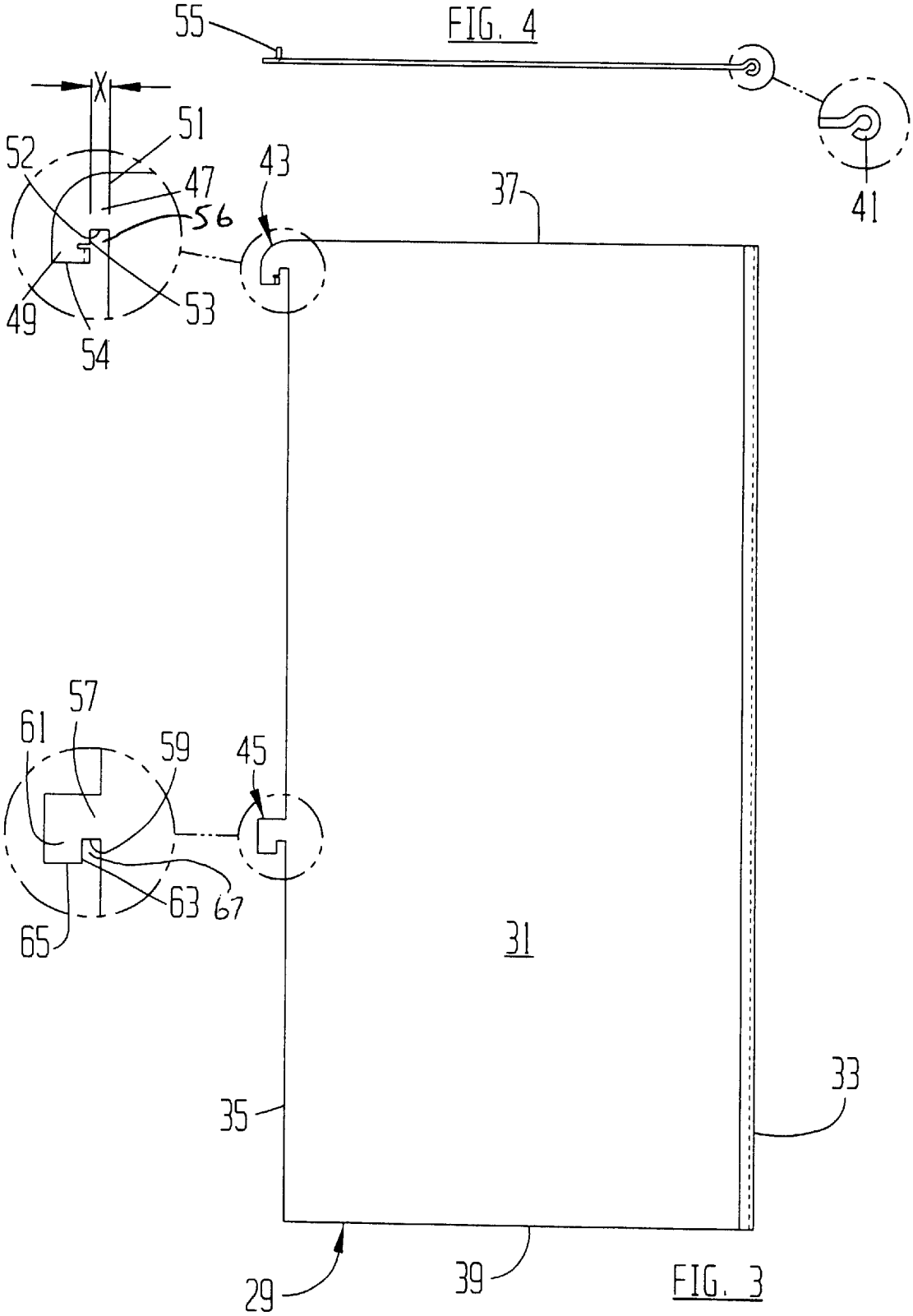
FIG. 3 is a side view of a floating partition that is advantageously used with the rack and box filing system of FIG. 1.
FIG. 4 is a top view of FIG. 3.
Figure 5:
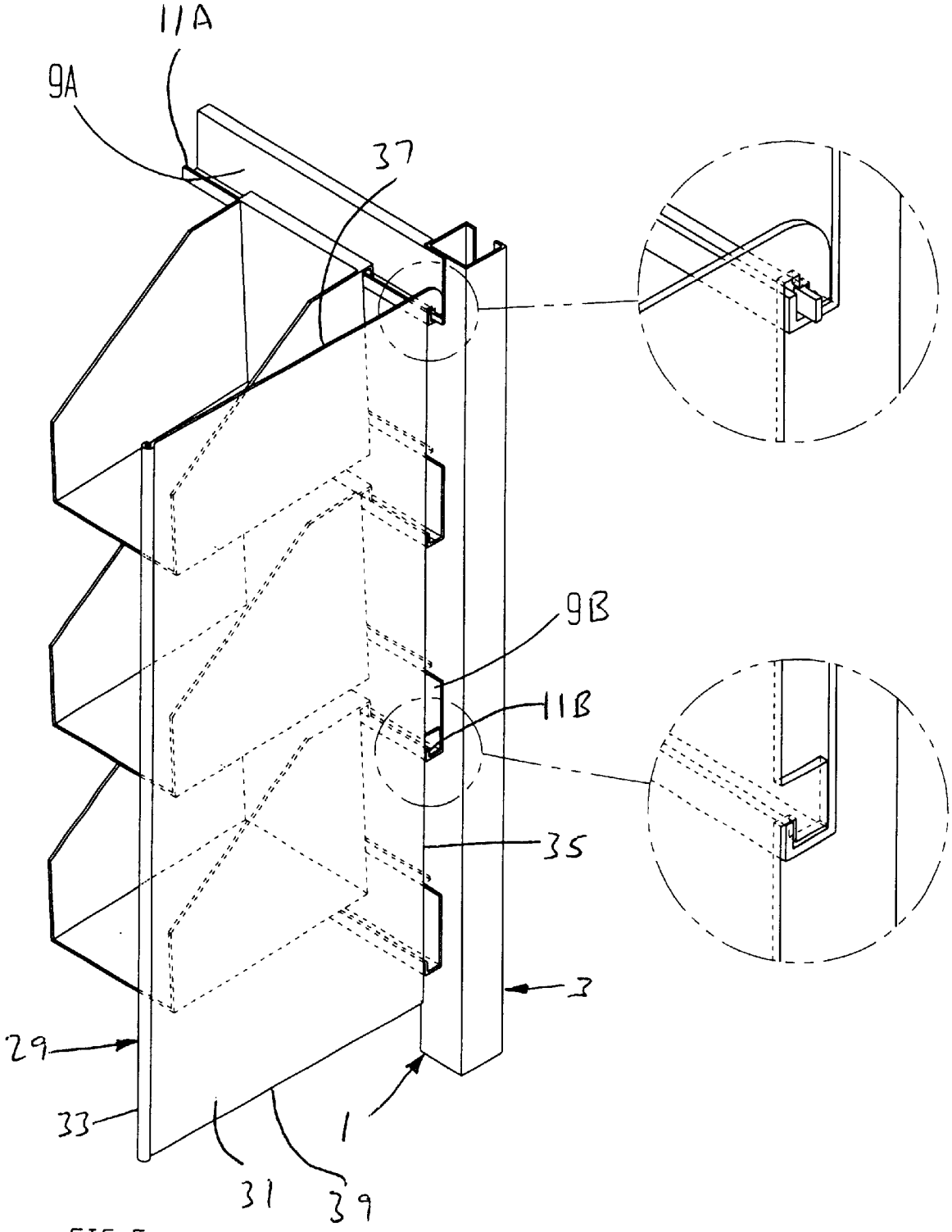
FIG. 5 is a perspective view of the floating partition of the invention in use on a rack and box filing system.

In accordance with the present invention, and also looking at FIGS. 3–5, a floating partition 29 is incorporated into the rack and box filing system 1. The floating partition 29 divides the long length of the rack 3 in the longitudinal directions 16 into shorter and more manageable sections. The floating partition is comprised of a flat panel 31 having a front edge 33, a back edge 35, a top edge 37, and a bottom edge 39. A preferred material for the panel 31 is sheet metal; a thickness of approximately 0.05 inches is satisfactory. The panel height between the top and bottom edges 37 and 39, respectively, is a little less than the distance between the rack base cover 8 and the top panel 15. The panel front edge 33 is formed with an eye attracting three-dimensional contour 41. In the particular construction shown, the contour 41 is a rounded-over bead. However, other geometric shapes for the panel front edge contour, including those with sharp angle bends, are also acceptable. Another benefit of the front edge three-dimensional contour is that it provides rigidity to the panel.

Figure 8:
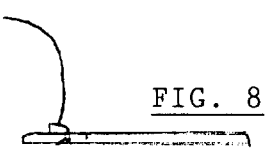
FIG. 8 is a top view of FIG. 7.
Figure 7:
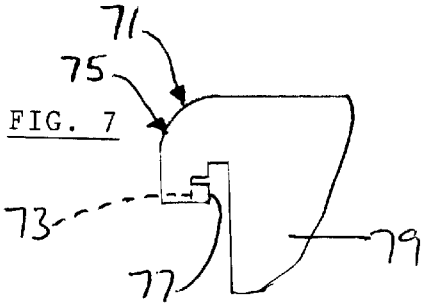
FIG. 7 is a partial side view of a modified floating partition.

On the back edge 35 of the floating partition panel is a top finger 43 and a bottom finger 45. In the preferred embodiment, the top and bottom fingers 43 and 45, respectively, are integral and coplanar with the panel 31. The top finger has a support edge 52 that is perpendicular to the panel back edge. The top finger also has an inside edge 53 that is parallel to and spaced a distance X from the panel back edge. A satisfactory amount for the distance X is approximately 0.25 inches. Thus, the panel back edge, support edge 52, and inside edge 53 cooperate to form a top recess 56 having the width X. The top finger also has a bottom edge 54 that intersects the inside edge and is perpendicular to it. A tab 55 is bent over from the inside edge and is next to the bottom edge 54. As illustrated, the tab 55 is at a right angle to the plane of the panel and the top finger. However the tab may be at other angles to the panel plane. FIGS. 7 and 8, for example, show an alternate floating partition 71 having a tab 73 on a top finger 75. The tab 73 is bent over from an inside edge 77 of the top finger 75 at approximately 180 degrees to the common plane of the panel 79 and the top finger.

The floating partition bottom finger 45 has an inside edge 63 that is generally colinear with the inside edge 53 of the top finger 43. The bottom finger has a support edge 59 and a bottom edge 65. The panel back edge 35, bottom finger support edge 59, and inside edge 63 cooperate to form a bottom recess 67. If desired, the bottom finger can also include a tab similar to the tab 55 on the top finger 43.

The distance between the support edges 52 and 59 of the top and bottom fingers 43 and 45, respectively, is accurately controlled to be the same as the distance between the lips of two rails 9, as, for example, the lips 11A and 11B of rails 9A and 9B, respectively,of FIG. 5. In addition, the distance between the bottom finger support edge and the panel bottom edge 39 is less than the distance between the rail lip 11B and the rack base cover 8.

Figure 6:
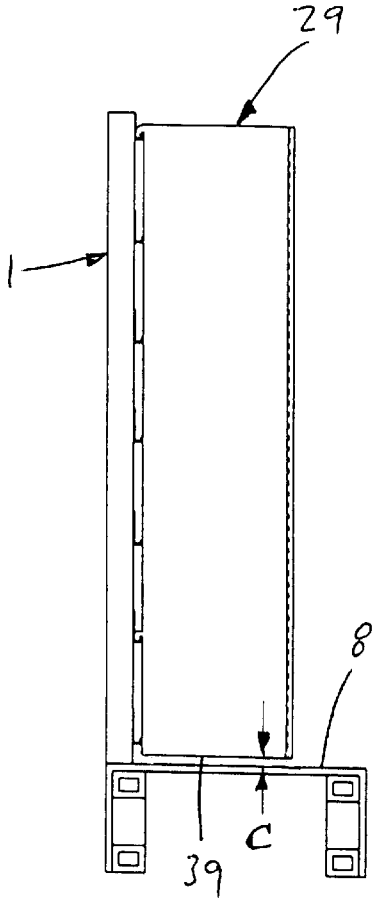
FIG. 6 is a simplified side view of the floating partition in place on a rack.

The floating partition 29 is mounted to the rack 3 by selecting a desired location along the rack. Because the panel 31 is thin, the partition can be located at almost any desired location without affecting the locations of the boxes 17. The panel is oriented vertically and lifted such that the bottom edges 54 and 65 of the top and bottom fingers 43 and 45, respectively, are higher than the lips 11A and 11B of the two rails 9A and 9B. The floating partition is moved horizontally toward the rails until the recesses 56 and 67 are over the lips 11A and 11B of the rails. Then the floating partition is lowered until the fingers support edges 52 and 59 rest on the rail lips. There is a clearance C between the bottom edge 39 of the panel 31 and the frame base cover 8. See FIG. 6. The tab 55 on the top finger enables the floating partition to be located at a gap 18 between adjacent rails without binding or falling out of the gap.

Figure 2A:
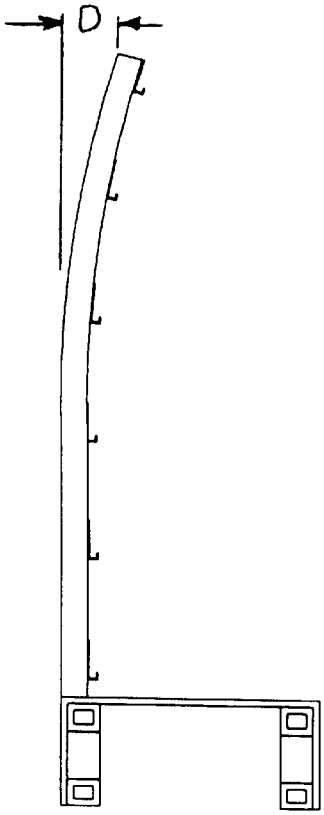
FIG. 2A is a simplified end view of the rack and box filing system of FIG. 2 with a large quantity of media stored in the boxes.

When the floating partition 29 is in place on a single-face installation of the rack and box filing system 1, it remains vertical and flat in place despite full loading of the boxes 17. The clearance C between the panel bottom edge 39 and the rack base cover 8 accommodates the horizontal deflections D of the rack posts 5 and rails 9 under load (FIG. 2A). Accordingly, the deflection of the posts does not cause the floating partition panel 31 to buckle or deform despite heavy loading on the rack 3. In addition to the floating partition providing an actual physical separation of the boxes, the three-dimensional contour 41 on the panel front edge provides separation between the boxes.

In summary, the results and advantages of rack and box filing systems 1 can now be more fully realized. The floating partition 29 provides both functional efficiency to long lengths of the system as well as ease of mounting and removal. This desirable result comes from using the combined functions of the fingers 43 and 45. The fingers cooperate with the panel back edge 35 to form the recesses 56 and 67. The fingers are sized and shaped to rest on the rails 9. The clearance C between the panel bottom edge 39 and the rack base cover 8 enables the floating partition to accommodate the horizontal deflection D of the posts during heavy single-face loading. In that manner, the pleasing aesthetics of the flatness of the panel 31 are maintained for all operating conditions. The tab 55 contributes to the flexibility of the invention by enabling the floating partition to be located at the gaps 18 between adjacent rails. The panel front edge three-dimensional contour 41 provides rigidity to the floating partition in addition to a visual enhancement of the dividing feature of the floating partition.

It will also be recognized that in addition to the superior performance of the invention, its construction is such as to be of modest cost in relation to the benefits it provides. In fact, the purchase price of the floating partition 29 represents an investment that is quickly recovered because of the increased productivity of the personnel using the rack and box filing system 1.

Thus, it is apparent that there has been provided, in accordance with the invention, a floating partition for filing equipment that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A floating partition useful for dividing a rack and box filing system into sections comprising:

a. a flat planar panel having top, bottom, front, and back edges, the front edge being formed with a three-dimensional contour between the top and bottom edges;

b. a top finger coplanar with the panel and cooperating therewith to form a first recess, the top finger having a top support edge;

c. a bottom finger coplanar with the panel and cooperating with the panel back edge to form a second recess, the bottom finger having a bottom support edge that is at a predetermined distance from the top finger support edge and from the panel bottom edge; and d. a tab on at least the top finger, the tab being non-coplanar with the plane of the panel.

2. The floating partition of claim 1 wherein:

a. each of the top and bottom fingers has a respective inside edge that is parallel to and spaced a predetermined distance from the panel back edge; and b. the tab is along the inside edge of said at least one of the top and bottom fingers.

3. The floating partition of claim 1 wherein:

a. the top finger has an inside edge parallel to and spaced a predetermined distance from the panel back edge; and b. the tab is along the top finger inside edges.

4. The floating partition of claim 1 wherein the tab is perpendicular to the plane of the panel.

5. The floating partition of claim 3 wherein the tab is bent over from the top finger inside edge at approximately 180 degrees to the plane of the panel.

6. In combination:

a. a rack comprising:

i. a plurality of upstanding posts;

ii. a plurality of rails extending in longitudinal directions between the posts, each rail having a lip with a predetermined thickness; and iii. a plurality of boxes suspended from the rails for storing selected media therein; and b. a floating partition mounted to the rack between selected boxes comprising:

i. a flat planar panel having top, bottom, front, and back edges;

ii. a top finger coplanar with the panel and having a top support edge that rests on the lip of a first rail; and iii. a bottom finger coplanar with the panel and having a bottom support edge that rests on the lip of a second rail, so that the floating partition provides a visual divide along the longitudinal lengths of the rails.

7. The combination of claim 6 wherein:

a. the rack further comprises a base cover at a predetermined distance from the lip of the second rail; and b. the bottom edge of the partition panel is spaced at a predetermined clearance from the rack base cover.

8. The combination of claim 6 wherein the floating partition further comprises a tab on at least the first finger, the tab being non-coplanar with the plane of the panel.

9. The combination of claim 7 wherein:

a. the top finger has an inside edge that cooperates with the panel back edge and the top support edge to define a first recess that receives the lip of the first rail; and b. the bottom finger has an inside edge that cooperates with the panel back edge and the bottom support edge to define a second recess that receives the lip of the second rail.

10. The combination of claim 6 wherein the panel front edge is formed with a rounded contour.

11. The combination of claim 9 further comprising a tab on the inside edge of at least one of the top and bottom finger.

12. The combination of claim 9 further comprising a tab on the inside edge of the top finger.

13. The combination of claim 11 wherein the tab is perpendicular to the plane of the panel.

14. The combination of claim 12 wherein the tab is bent over at approximately 180 degrees to the plane of the panel.

15. The combination of claim 6 wherein the front edge of the panel is formed with a three-dimensional contour between the top and bottom edges that enhances the visual divide of the floating partition.

16. A rack and box filing system comprising:

a. a rack comprising at least two spaced apart upright posts;

b. at least two rails extending between said at least two posts, each rail having a lip with a predetermined thickness;

c. a plurality of boxes suspended from said at least two rails for storing selected media; and d. at least one floating partition mounted to said at least two rails and comprising:

i. a panel that defines a substantially flat panel plane and has top, bottom, back, and front edges;

ii. a top finger coplanar with the panel plane and having a top support edge resting on the lip of one of said at least two rails; and iii. a bottom finger coplanar with the panel plane and having a bottom support edge resting on the lip of the other of said at least two rails, so that said at least one floating partition provides a visual divide along the boxes.

17. The rack and box filing system of claim 16 wherein said at least one floating partition further comprises a tab on at least the top finger that is non-coplanar with the panel plane.

18. The rack and box filing system of claim 16 wherein:

a. each of the top and bottom fingers has an inside edge that is spaced from and parallel to the panel back edge; and b. said at least one floating partition further comprises a tab along the inside edge of at least the top finger, the tab being perpendicular to the panel plane.

19. The rack and box filing system of claim 16 wherein:

a. the rack further comprises a base cover; and b. said at least one floating partition panel bottom edge is spaced at a predetermined clearance from the rack base cover.

20. The rack and box filing system of claim 16 wherein the top and bottom fingers cooperate with the panel back edge to define top and bottom recesses having respective predetermined widths, the top and bottom recesses receiving the lips of respective rails.

21. The rack and box filing system of claim 16 wherein:

a. each of the top and bottom fingers has an inside edge that is spaced from and parallel to the panel back edge; and b. said at least one floating partition further comprises a tab along the inside edge of at least the top finger, the tab being bent over at approximately 180 degrees to the panel plane.

22. The rack and box filing system of claim 16 wherein the front edge of the panel of said at least one floating partition is formed with a three-dimensional contour that provides an enhanced visual divide along the boxes.

23. The rack and box filing system of claim 22 wherein the three-dimensional contour on the front edge of the panel is a rounded-over contour between the panel top and bottom edges.

24. A method of providing a visual divide along a long section of boxes suspended from longitudinally extending rails of a rack having a base cover comprising the steps of:

a. providing a floating partition having a flat planar panel with front, back, top, and bottom edges, and with top and bottom fingers; and b. resting the floating partition top and bottom fingers on first and second rails between selected boxes.

25. The method of claim 24 wherein the step of providing a floating partition comprises the further step of providing a tab on at least the top finger that is non-coplanar with the panel plane.

26. The method of claim 24 wherein the step of providing a floating partition comprises the further step of providing a tab on the top finger that is perpendicular to the panel plane.

27. The method of claim 24 comprising the further step of spacing the floating partition panel bottom edge at a predetermined clearance from the rack base cover.

28. The method of claim 24 wherein the step of providing a floating partition comprises the further step of providing a tab on the top finger that is bent over at approximately 180 degrees to the panel plane.

29. The method of claim 24 wherein the step of providing a floating partition comprises the step of forming the panel front edge with a three-dimensional contour between the panel top and bottom edges.

* * * * *